US012060884B2

(12) United States Patent
Hirayama et al.

(10) Patent No.: US 12,060,884 B2
(45) Date of Patent: Aug. 13, 2024

(54) ROTARY COMPRESSOR AND REFRIGERATION CYCLE APPARATUS

(71) Applicant: Carrier Japan Corporation, Shinagawa-ku (JP)

(72) Inventors: Takuya Hirayama, Fuji (JP); Shogo Shida, Fuji (JP)

(73) Assignee: CARRIER JAPAN CORPORATION, Tokyo (JP)

( * ) Notice: Subject to any disclaimer, the term of this patent is extended or adjusted under 35 U.S.C. 154(b) by 552 days.

(21) Appl. No.: 17/196,301

(22) Filed: Mar. 9, 2021

(65) Prior Publication Data

US 2021/0190072 A1 Jun. 24, 2021

Related U.S. Application Data

(63) Continuation of application No. PCT/JP2018/034269, filed on Sep. 14, 2018.

(51) Int. Cl.
*F04C 29/06* (2006.01)
*F04C 29/12* (2006.01)

(52) U.S. Cl.
CPC ..... *F04C 29/065* (2013.01); *F04C 29/068* (2013.01); *F04C 29/12* (2013.01); *F04C 2240/52* (2013.01)

(58) Field of Classification Search
CPC .... F04C 29/065; F04C 29/12; F04C 2240/52; F04C 23/001; F04C 23/008; F04C 29/068; F04C 18/3564
See application file for complete search history.

(56) References Cited

U.S. PATENT DOCUMENTS 11,326,605 B2 * 5/2022 Lee ..... F04C 18/3564
11,339,999 B2 * 5/2022 Aoki ..... F25B 43/006
(Continued)

FOREIGN PATENT DOCUMENTS

CN 102644592 A 8/2012
CN 103827500 A 5/2014
(Continued)

OTHER PUBLICATIONS

International Search Report issued Nov. 27, 2018 in connection with PCT International Patent Application No. PCT/JP2018/034269.
(Continued)

*Primary Examiner* — Dominick L Plakkoottam
(74) *Attorney, Agent, or Firm* — John P. White

(57) ABSTRACT

According to one embodiment, a rotary compressor includes a compression mechanism unit. The compression mechanism unit includes at least three cylinder bodies interposed between a first bearing and a second bearing, a plurality of partition plates provided between adjacent cylinder bodies, and a plurality of rollers compressing a working fluid in cylinder chambers of the cylinder bodies, and at least three cylinder chambers are partitioned by an end plate of the first bearing, an end plate of the second bearing, and the partition plates. Each of the end plates includes a first discharge port discharging the working fluid to a muffler chamber. Each of a plurality of partition plates includes an intermediate muffler chamber, and a second discharge port discharging the working fluid.

13 Claims, 6 Drawing Sheets

(56) References Cited

U.S. PATENT DOCUMENTS

| | | | | |
|---|---|---|---|---|
| 2006/0056987 | A1* | 3/2006 | Seok | F04C 23/001 417/273 |
| 2010/0147013 | A1* | 6/2010 | Hirayama | F04C 23/008 62/401 |
| 2014/0096561 | A1* | 4/2014 | Hirayama | F04C 18/356 418/58 |
| 2014/0250937 | A1* | 9/2014 | Hirayama | F04C 29/065 418/60 |
| 2016/0018136 | A1* | 1/2016 | Hirayama | F25B 49/02 62/401 |

FOREIGN PATENT DOCUMENTS

| | | | |
|---|---|---|---|
| CN | 105065274 | A | 11/2015 |
| CN | 106574620 | A | 4/2017 |
| CN | 207004815 | A | 2/2018 |
| EP | 3184822 | A1 | 6/2017 |
| JP | 2011-064183 | A | 3/2011 |
| JP | 2013-083245 | A | 5/2013 |
| JP | 2014-190175 | A | 10/2014 |
| JP | 2015-175258 | A | 10/2015 |
| JP | 2016-044600 | A | 4/2016 |
| KR | 100585809 | B1 * | 6/2006 |

OTHER PUBLICATIONS

Chinese official action dated Apr. 27, 2022 (and English translation), in connection with Chinese Patent Application No. 201880097447.1.

* cited by examiner

ROTARY COMPRESSOR AND REFRIGERATION CYCLE APPARATUS

CROSS-REFERENCE TO RELATED APPLICATIONS

This application is a Continuation Application of POT Application No. PCT/JP2018/034269, filed Sep. 14, 2013, the entire contents of which are incorporated herein by reference.

Embodiments described herein relate generally to a multi-cylinder rotary compressor and a refrigeration cycle apparatus comprising the rotary compressor.

BACKGROUND

In recent years, a three-cylinder rotary compressor having three sets of refrigerant compression units arranged in the axial direction of a rotating shaft has been developed in order to increase the refrigerant compression capacity. Three sets of refrigerant compression units are interposed between a pair of bearings that support the rotating shaft, and a partition plate is provided between the refrigerant compression units adjacent to each other in the axial direction of the rotating shaft.

Furthermore, each of three sets of refrigerant compression units includes a cylinder chamber through which the rotating shaft penetrates. The cylinder chamber is partitioned in the axial direction of the rotating shaft by the partition plate and the end plates of the pair of bearings, and rollers are accommodated in each cylinder chamber. The roller eccentrically rotates in the cylinder chamber, integrally with the rotating shaft, to compress the refrigerant sucked into the cylinder chamber.

The refrigerant compressed in the cylinder chamber is discharged to the outside of the refrigerant compression unit through each discharge port. However, according to the conventional three-cylinder rotary compressor, particularly, securing the capacity of the discharge passage communicating with the cylinder chamber located in the middle is difficult since only one discharge port is present for each cylinder chamber.

As a result, the discharge loss and discharge pressure pulsation of the refrigerant discharged from the intermediate cylinder chamber cannot be sufficiently reduced, and room for improvement of the performance of the rotary compressor or improvement for noise suppression during operation of the rotary compressor is left.

Embodiments described herein aim to obtain a rotary compressor capable of suppressing the discharge loss and discharge pulsation of the working fluid discharged from all the cylinder chambers to a low level.

DETAILED DESCRIPTION

In general, according to one embodiment, the rotary compressor comprises a sealed container, a compression mechanism unit that compresses a working fluid inside the sealed container, and a drive source that is accommodated in the sealed container and drives the compression mechanism unit.

The compression mechanism unit includes a rotating shaft connected to the drive source inside the sealed container, a first bearing and a second bearing rotatably supporting the rotating shaft and including end plates extending in a radial direction of the rotating shaft, a first muffler chamber attached to the first bearing, a second muffler chamber attached to the second bearing, at least three cylinder bodies interposed between the first bearing and the second bearing, and spaced apart and arranged in an axial direction of the rotating shaft, each defining a cylinder chamber, a plurality of partition plates provided between the adjacent cylinder bodies, and a plurality of rollers fitted in the rotating shaft to compress the working fluid in the cylinder chambers, and the cylinder chambers of the at least three cylinder bodies are partitioned in an axial direction of the rotating shaft by the end plate of the first bearing, the end plate of the second bearing, and the partition plates.

Each of the end plate of the first bearing and the end plate of the second bearing includes a first discharge port discharging the working fluid compressed in the cylinder chamber of the cylinder body adjacent to the end plate to the first muffler chamber and the second muffler chamber, and each of the plurality of partition plates that sandwich the intermediate cylinder body located between the two cylinder bodies adjacent to the end plates includes an intermediate muffler chamber in which the working fluid flows, and a second discharge port discharging the working fluid compressed in the cylinder chamber of the intermediate cylinder body to the intermediate muffler chamber.

First Embodiment

A first embodiment will be described hereinafter with reference to FIGS. 1 to 4.

Figure 1:
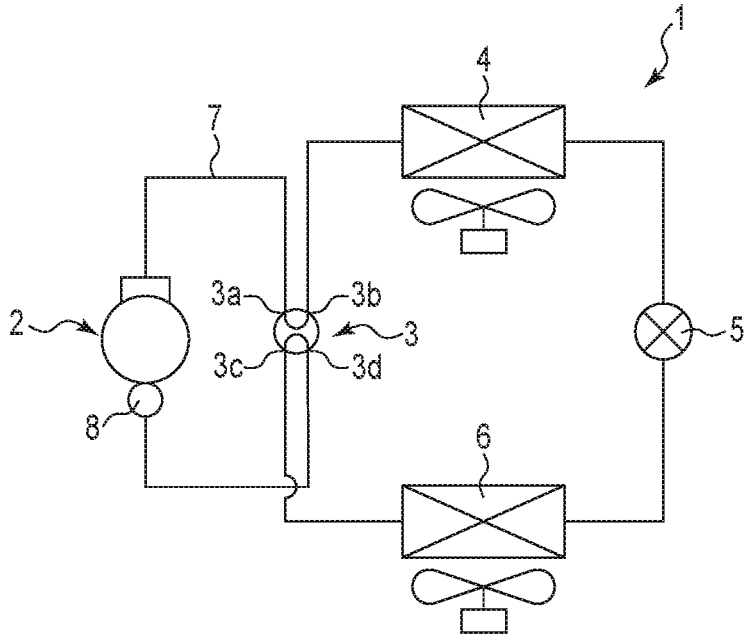
FIG. 1 is a circuit diagram schematically showing a configuration of a refrigeration cycle apparatus according to a first embodiment.

FIG. 1 is a refrigeration cycle circuit diagram of an air conditioner 1, which is an example of a refrigeration cycle apparatus. An air conditioner 1 comprises a rotary compressor 2, a four-way valve 3, an outdoor heat exchanger 4, an expansion device 5, and an indoor heat exchanger 6 as main elements. The plurality of elements constituting the air conditioner 1 are connected via a circulation circuit 4 in which a refrigerant serving as a working fluid circulates.

More specifically, as shown in FIG. 1, the discharge side of the rotary compressor 2 is connected to a first port 3*a* of the four-way valve 3. A second port 3*b* of the four-way valve 3 is connected to the outdoor heat exchanger 4. The outdoor heat exchanger 4 is connected to the indoor heat exchanger 6 via the expansion device 5. The indoor neat exchanger 6 is connected to a third port 3*c* of the four-way valve 3. A fourth port 3*d* of the four-way valve 3 is connected to an accumulator 8 which is the suction side of the rotary compressor 2.

When the air conditioner 1 operates in the cooling mode, the four-way valve 3 is switched such that the first port 3*a* communicates with the second port 3*b* and the third port 3*c* communicates with the fourth port 3*d*. When the operation of the air conditioner 1 is started in the cooling mode, a high-temperature and high-pressure vapor-phase refrigerant compressed by the rotary compressor 2 is guided to the outdoor heat exchanger 4 that functions as a radiator (condenser) through the four-way valve 3.

The vapor-phase refrigerant guided to the outdoor heat exchanger 4 is condensed by heat exchange with air and changed to a high-pressure liquid-phase refrigerant. The high-pressure liquid-phase refrigerant is decompressed in the process of passing through the expansion device 5 and changes to a low-pressure gas-liquid two-phase refrigerant. The gas-liquid two-phase refrigerant is guided to the indoor heat exchanger 6 that functions as a heat absorber (evaporator), and exchanges heat with air in the process of passing through the indoor heat exchanger 6.

As a result, the gas-liquid two-phase refrigerant takes heat from the air and evaporates, and changes to a low-temperature and low-pressure vapor-phase refrigerant. The air passing through the indoor heat exchanger 6 is cooled by latent heat of vaporization of the liquid-phase refrigerant, becomes cola air, and is sent to a place to be air-conditioned (cooled).

The low-temperature and low-pressure vapor-phase refrigerant that has passed through the indoor heat exchanger 6 is guided to the accumulator 3 via the four-way valve 3. When the liquid-phase refrigerant that cannot be completely evaporated is mixed in the refrigerant, the liquid-phase refrigerant is separated into the liquid-phase refrigerant and the vapor-phase refrigerant by the accumulator 8. The low-temperature and low-pressure vapor-phase refrigerant from which the liquid-phase refrigerant is separated is sucked into the compression mechanism unit of the rotary compressor 2, and is compressed again into the high-temperature and high-pressure vapor-phase refrigerant by the rotary compressor 2 and discharged to the circulation circuit 7.

In contrast, when the air conditioner 1 operates in the heating mode, the four-way valve 3 is switched such that the first port 3*a* communicates with the third port 3*c* and the second port 3*b* communicates with the fourth port 3*d*. For this reason, the high-temperature and high-pressure vapor-phase refrigerant discharged from the rotary compressor 2 is guided to the indoor heat exchanger 6 via the four-way valve 3 and exchanges heat with the air passing through the indoor neat exchanger 6. That is, the indoor heat exchanger 6 functions as a condenser.

As a result, the vapor-phase refrigerant passing through the indoor heat exchanger 6 is condensed by heat exchange with air and changed to a high-pressure liquid-phase refrigerant. The air passing through the indoor heat exchanger 6 is heated by heat exchange with the vapor-phase refrigerant, becomes warm air, and is sent to a place to be air-conditioned (heated).

The nigh-temperature liquid-phase refrigerant that has passed through the indoor heat exchanger 6 is guided to the expansion device 5, and is decompressed in the process of passing through the expansion device 5 to change to a low-pressure gas-liquid two-phase refrigerant. The gas-liquid two-phase refrigerant is guided to the outdoor heat exchanger 4 that functions as an evaporator, and evaporates by exchanging heat with air and changes to a low-temperature and low-pressure vapor-phase refrigerant. The low-temperature and low-pressure vapor-phase refrigerant that has passed through the outdoor heat exchanger 4 is guided to the accumulator S of the rotary compressor 2 via the four-way valve 3.

Figure 2:
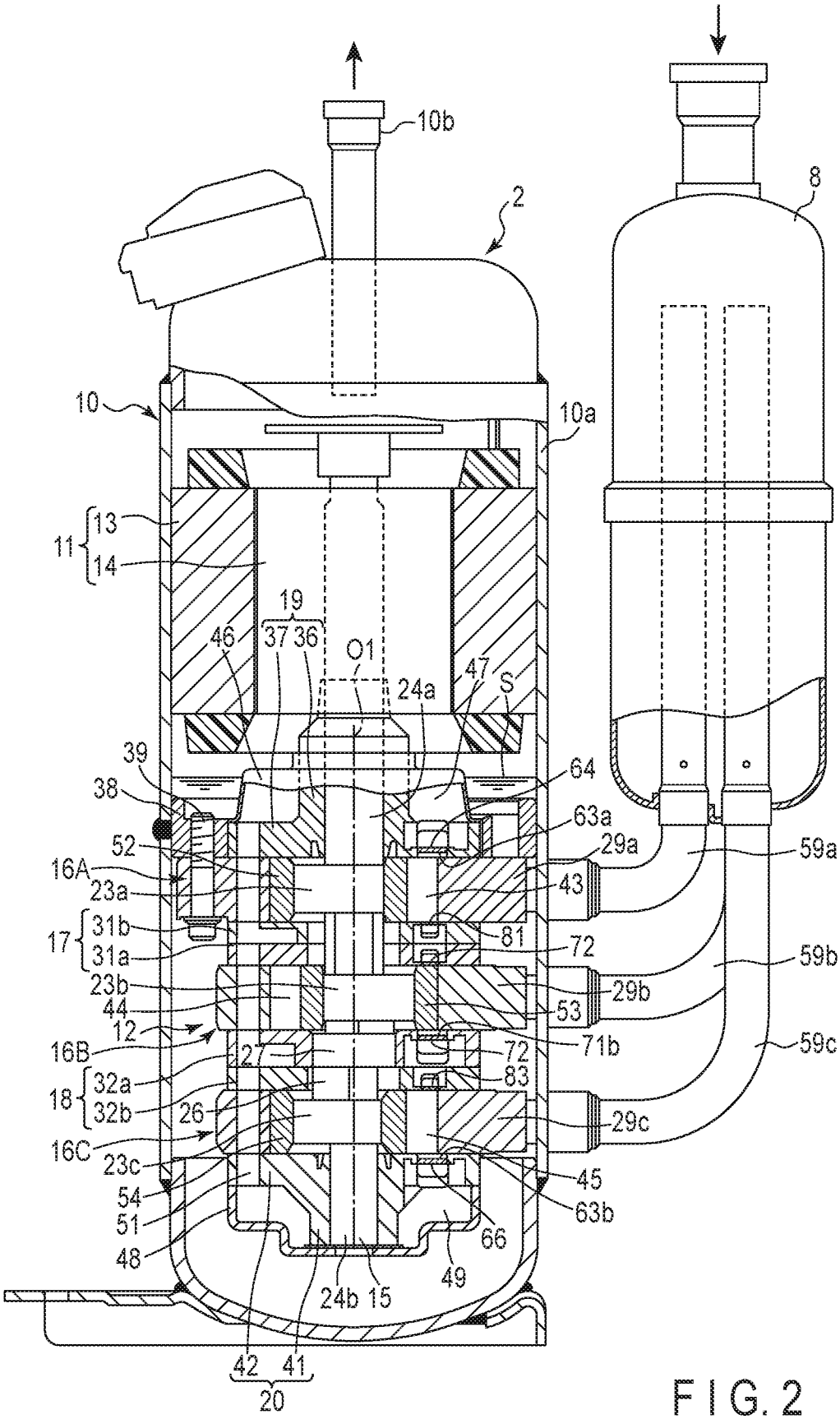
FIG. 2 is a cross-sectional view of a three-cylinder rotary compressor according to the first embodiment.

Next, a specific configuration of the rotary compressor 2 will be described with reference to FIGS. 2 to 4. FIG. 2 is a cross-sectional view showing the vertical three-cylinder rotary compressor 2. As shown in FIG. 2, the three-cylinder rotary compressor 2 comprises a sealed container 10, an electric motor 11, and a compression mechanism unit 12 as main elements.

The sealed container 10 includes a cylindrical peripheral wall 10*a* and is erected along the vertical direction. Lubricating oil is stored inside a sealed container 10*a*. A discharge pipe 10*b* is provided at an upper end of the sealed container 10. The discharge pipe 10*b* is connected to the first port 3*a* of the four-way valve 3 via the circulation circuit 7.

The electric motor 11 is an example of a drive source, and is accommodated in an intermediate part of the sealed container 10 along the axial direction so as to be located above a liquid level S of the lubricating oil. The electric motor 11 is a so-called inner rotor type motor and comprises a stator 13 and a rotor 14. The stator 13 is fixed to an inner surface of the peripheral wall 10*a* of the sealed container 10. The rotor 14 is surrounded by the stator 13.

The compression mechanism unit 12 is accommodated in the lower part of the sealed container 10 so as to be immersed in the lubricating oil. As shown in FIGS. 2 and 3, the compression mechanism unit 12 comprises as main elements a rotating shaft 15, a first refrigerant compression unit 16A, a second refrigerant compression unit 16B, a third refrigerant compression unit 16C, a first partition plate 17, a second partition plate 18, a first bearing 19, and a second bearing 20.

The rotating shaft 15 has a straight central axis O1 that is erected along the axial direction of the sealed container 10. The rotating shaft 15 includes a first journal portion 24*a* located at the upper part, a second journal portion 24*b* located at the lower end part, first to third crank portions 23*a*, 23*b*, and 23*c*, and a first intermediate shaft portion 25 and a second intermediate shaft portion 26 located between the first journal portion 24*a* and the second journal portion 24*b*. The first journal portion 24*a*, the second journal portion 24*b*, the first intermediate shaft portion 25, and the second intermediate shaft portion 26 are coaxially located on the central axis O1 of the rotating shaft 15. The rotor 14 of the electric motor 11 is connected to an upper end of the first journal portion 24*a*.

The first to third crank portions 23*a*, 23*b*, and 23*c* are located between the first journal portion 24*a* and the second, journal portion 24*b*. The first, to third, crank portions 23*a*, 23*b*, and 23*c* are disk-shaped elements each having a circular cross-section, and are arranged at intervals in the axial direction of the rotating shaft 15.

Furthermore, the first to third crank portions 23*a*, 23*b*, and 23*c* are eccentric with respect to the central axis O1 of the rotating shaft 15. That is, the eccentric directions of the first to third crank portions 23*a*, 23*b*, and 23*c* with respect to the central axis O1 are deviated by, for example, 120° in the circumferential direction of the rotating shaft 15.

The first intermediate shaft portion 25 is located between the first crank portion 23*a* and the second crank portion 23*b* on the central axis O1. The second intermediate shaft portion 26 is located between the second crank portion 23*b* and the third crank portion 23*c* on the central axis O1.

Furthermore, the second intermediate shaft portion 26 includes a third journal portion 27. The third journal portion 27 is a disk-shaped element having a circular cross-section, and is located coaxially with the central axis O1 of the rotating shaft 15. The third journal portion 27 has an outer diameter larger than that of the other portions of the second intermediate shaft portion 26, and is provided at a position offset to the side of the second crank portion 23*b* with respect to the third crank portion 23*c*.

Figure 3:
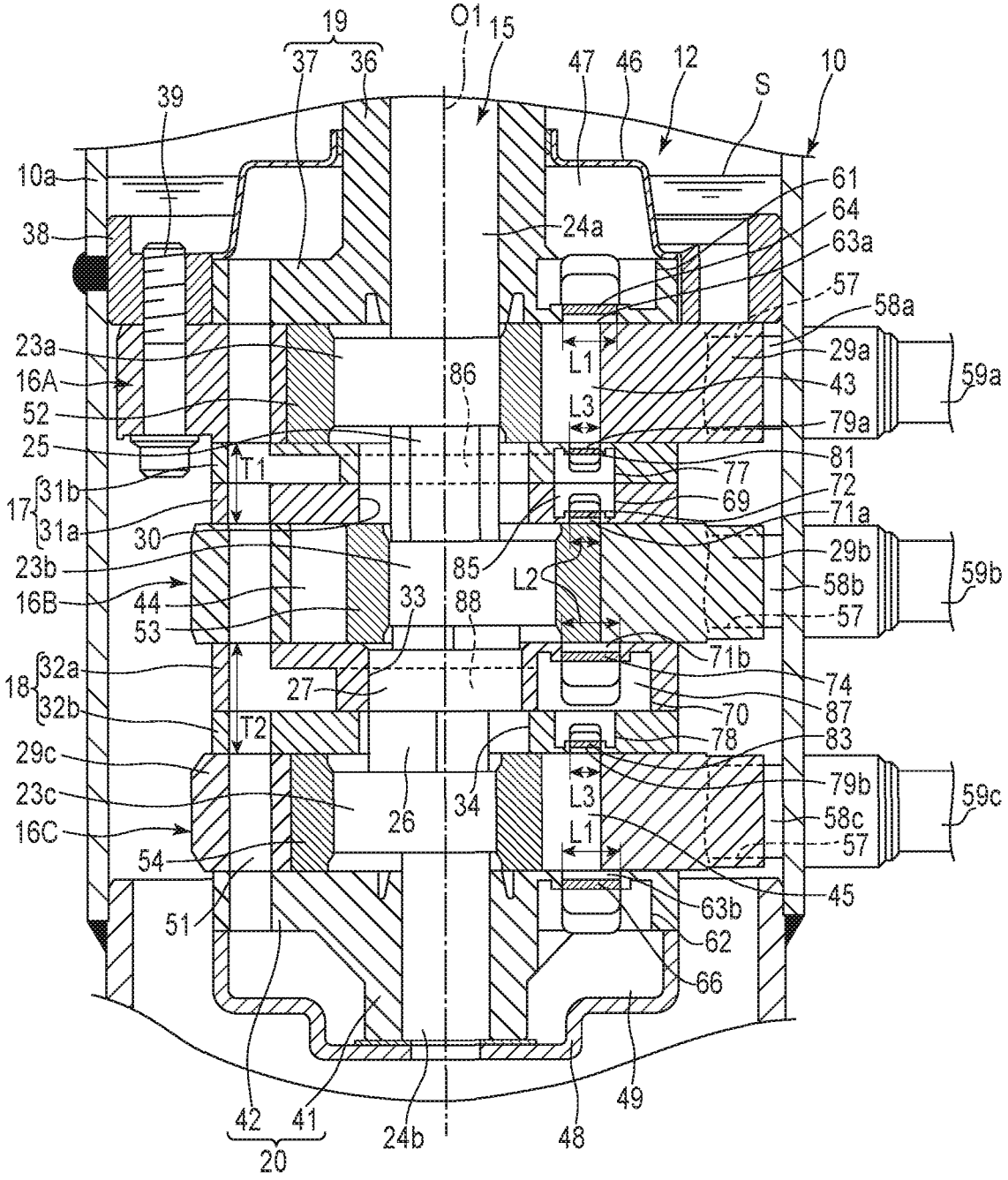
FIG. 3 is an enlarged cross-sectional view showing a compression mechanism unit of the three-cylinder rotary compressor in the first embodiment.

As shown in FIGS. 2 and 3, the first to third refrigerant compression units 16A, 16B, and 16C are arranged in a row at intervals, in the axial direction of the rotating shaft 15, inside the sealed container 10. The first to third refrigerant compression units 16A, 163, and 16C include a first cylinder body 29*a*, a second cylinder body 29*b*, and a third cylinder body 29*c*, respectively. The first to third cylinder bodies 29*a*, 29*b*, and 29*c* are set to have, for example, the same thickness along the axial direction of the rotating shaft 15.

According to the present embodiment, the first crank portion 23*a* of the rotating shaft 15 is located 29*a*. The second crank portion 23*b* of the rotating shaft 15 is located at an inner diameter part of the second cylinder body 29*b*. The third crank portion 23*c* of the rotating shaft 15 is located at an inner diameter part of the third cylinder body 29*c*.

As shown in FIG. 3, the first partition plate 17 is interposed between the first cylinder body 29*a* and the second cylinder body 29*b*. An upper surface of the first partition plate 17 is in contact with a lower surface of the first cylinder body 29*a* so as to cover the inner diameter part of the first cylinder body 29*a* from below. A lower surface of the first partition plate 17 is in contact with an upper surface of the second cylinder body 29*b* so as to cover the inner diameter part or the second cylinder body 29*b* from above.

Furthermore, a circular through hole 30 is formed in a central part of the first partition plate 17. The through hole 30 is located between the inner diameter part of the first cylinder body 29*a* and the inner diameter part of the second cylinder body 29*b*, and the first intermediate shaft portion 25 of the rotating shaft 15 penetrates the through hole 30.

According to the present embodiment, the first partition plate 17 is divided into a pair of disk-shaped plate elements 31*a* and 31*b*. The plate elements 31*a* and 31*b* are overlaid on each other in the axial direction of the rotating shaft 15. The axial direction of the rotating shaft 15 can be rephrased as the thickness direction of the plate elements 31*a* and 31*b*. One of the plate elements, i.e., the plate element 31*a* is in contact with the upper surface of the second cylinder body 29*b*. The other plate element, i.e., the plate element 31*b* is in contact with the lower surface of the first cylinder body 29*a*.

The second partition plate 13 is interposed between the second cylinder body 29*b* and the third cylinder body 29*c*. The upper surface of the second partition plate 13 is in contact with the lower surface of the second cylinder body 29*b* so as to cover the inner diameter part of the second cylinder body 29*b* from below. The lower surface of the second partition plate 18 is in contact with the upper surface of the third cylinder body 21*c* so as to cover the inner diameter part of the third cylinder body 21*c* from above.

According to the present embodiment, a thickness dimension T2 of the second partition plate 18 is larger than a thickness dimension T1 of the first partition plate 17. Furthermore, the second partition plate 13 is divided into a pair of disk-shaped plate elements 32*a* and 32*b*. The plate elements 32*a* and 32*b* are overlaid on each other in the axial direction of the rotating shaft 15. The axial direction of the rotating shaft 15 can be rephrased as the thickness direction of the plate elements 32*a* and 32*b*. One of the plate elements, i.e., the plate element 32*a* is in contact with the lower surface of the second cylinder body 29*b*. The other plate element, i.e., the plate element 32*b* is in contact with the upper surface of the third cylinder body 29*c*.

According to the present embodiment, the plate element 32*a* of the second partition plate 18 is formed to be thicker than the plate element 32*b*. As shown in FIG. 3, a circular bearing hole 33 is provided in the central part of the plate element 32*a*. A circular communication hole 34 is provided in the central part of the plate element 32*b* of the second partition plate 18. The communication hole 34 has a diameter larger than the bearing hole 33 and is made to coaxially communicate with the bearing hole 33.

The bearing hole 33 and the communication hole 34 are located between the inner diameter part of the second cylinder body 29*b* and the inner diameter part of the third cylinder body 29*c*, and the second intermediate shaft portion 26 of the rotating shaft 15 penetrates the bearing hole 33 and the communication hole 34.

The third journal portion 27 provided in the second intermediate shaft portion 26 is slidably fitted in the bearing hole 33 of the second partition plate 18 in the axial direction. By this fitting, the second partition plate 18 also functions as a third bearing that supports the rotating shaft 15 between the second cylinder body 29*b* and the third cylinder body 29*c*.

As shown in FIGS. 2 and 3, the first bearing 19 is arranged on the first cylinder body 29*a*. The first bearing 19 includes a tubular bearing body 36 that rotatably supports the first journal portion 24*a* of the rotating shaft 15 in the axial direction, and a flange-shaped end plate 37 extending from one end of the bearing body 36 in the radial direction of the rotating shaft 15. The end plate 37 is overlapped on the upper surface of the first cylinder body 29*a* so as to cover the inner diameter part of the first cylinder body 29*a* from above.

The end plate 37 of the first bearing 19 is surrounded by a ring-shaped support frame 33. The support frame 38 is fixed to a predetermined position on the inner surface of the peripheral wall 10*a* of the sealed container 10 by, for example, means such as welding.

A first cylinder body 29*a* is connected to the lower surface of the support frame 38 via a plurality of fastening bolts 39 (only one shown).

Furthermore, the end plate 37 of the first bearing 19, the first cylinder body 29*a*, the first partition plate 17, and the second cylinder body 29*b* are overlaid in the axial direction of the rotating shaft 15, and are integrally connected via a plurality of fastening bolts (not shown).

The second bearing 20 is arranged below the third cylinder body 29*c*. The second bearing 20 includes a tubular bearing body 41 that rotatably supports the second journal portion 24*b* of the rotating shaft 15 in the axial direction, and a flange-shaped end plate 42 extending from one end of the bearing body 41 in the radial direction of the rotating shaft 15. The end plate 42 is overlaid on the lower surface of the third cylinder body 29*c* so as to cover the inner diameter part of the third cylinder body 29*c* from below.

The end plate 42 of the second bearing 20, the third cylinder body 29*c*, the second partition plate 18, and the second cylinder body 29*b* are overlaid in the axial direction of the sealed container 10 and integrally connected via a plurality of fastening bolts (not shown).

According to the present embodiment, a region surrounded by the inner diameter part of the first cylinder body 29*a*, the first partition plate 17, and the end plate 37 of the first bearing 19 defines a first cylinder chamber 43. The first crank portion 23*a* of the rotating shaft 15 is accommodated in the first cylinder chamber 43.

A region surrounded by the inner diameter part of the second cylinder body 29*b*, the first partition plate 17, and the second partition plate 18 defines a second cylinder chamber 44. The second crank portion 23*b* of the rotating shaft 15 is accommodated in the second cylinder chamber 44.

Furthermore, a region surrounded by the inner diameter part of the third cylinder body 29*c*, the second partition plate 18, and the end plate 42 of the second bearing 20 defines a third cylinder chamber 45. The third crank portion 23*c* of the rotating shaft 15 is accommodated in the third cylinder chamber 45.

As shown in FIGS. 2 and 3, a first muffler cover 46 is attached to the first bearing 19. The first muffler cover 46 and the first bearing 19 cooperate with each other to define a first muffler chamber 47. The first muffler chamber 47 is attached around the first bearing 19 so as to surround the bearing body 36 of the first bearing 19 and is spaced from the first cylinder chamber 47 by the end plate 37 of the first bearing 19.

Furthermore, the first muffler chamber 47 has a sufficient capacity for enhancing the muffling effect, and is opened inside the sealed container 10 through a plurality of exhaust holes (not shown) included in the first muffler cover 46.

A second muffler cover 48 is attached to the second bearing 20. The second muffler cover 48 and the second bearing 20 cooperate with each other to define a second muffler chamber 49. The second muffler chamber 49 is attached around the second bearing 20 so as to surround the bearing body 41 of the second bearing 20, raid is separated from the third cylinder chamber 45 by the end plate 42 of the second bearing 20.

Furthermore, the second muffler chamber 49 has a sufficient capacity for enhancing the muffling effect. According to the present embodiment, the second muffler chamber 49 communicates with the first muffler chamber 47 via a discharge passage 51 extending in the axial direction of the rotating shaft 15. The discharge passage 51 continuously penetrates outer peripheral portions of the first to third cylinder bodies 29*a*, 29*b*, and 29*c*, and the outer peripheral portions of the first and second partition plates 17 and 13 first and second partitions so as to connect the first muffler chamber 47 and the second muffler chamber 49.

As shown in FIGS. 2 and 3, a ring-shaped first roller 52 is fitted in the outer peripheral surface of the first crank portion 23*a*. The first roller 52 rotates eccentrically inside the first cylinder chamber 43, integrally with the rotating shaft 15, and a part of the outer peripheral surface of the first roller 52 cooperates with the inner peripheral surface of the inner diameter portion of the first cylinder body 29*a* to form a seal portion.

An upper end surface of the first roller 52 is slidably inn contact with a lower surface of the end plate 37 of the first bearing IS. The lower end surface of the first roller 52 is slidably in contact with the upper surface of the first partition plate 17 around the through hole 30. The airtightness of the first cylinder chamber 43 is thereby secured.

A ring-shaped second roller 53 is fitted in the outer peripheral surface of the second crank portion 23*b*. The second roller 53 rotates eccentrically inside the second cylinder chamber 44, integrally with the rotating shaft 15, and a part of the outer peripheral surface of the second roller 53 cooperates with an inner peripheral surface of the inner diameter part of the second cylinder body 29*b* to firm a seal portion.

The upper end surface of the second roller 53 is slidably in contact with the lower surface of the first partition plate 17 around the through hole 30. The lower end surface of the second roller 53 is slidably in contact with the upper surface of the second partition plate 13 around the bearing hole 33. The airtightness of the second cylinder chamber 44 is thereby secured.

A ring-shaped third roller 54 is fitted in the outer peripheral surface of the third crank portion 23*c*. The third roller 54 rotates eccentrically inside the third cylinder chamber 45, integrally with the rotating shaft 15, and a part of the outer peripheral surface of the third roller 54 cooperates with the inner peripheral surface of the inner diameter part of the third cylinder body 29*c* to form a seal portion.

The upper end surface of the third roller 54 is slidably in contact with the lower surface of the second partition plate 18 around the communication hole 34. A lower end surface of the third roller 54 is slidably in contact with an upper surface of the end plate 42 of the second bearing 20. The airtightness of the third cylinder chamber 45 is thereby secured.

Figure 4:
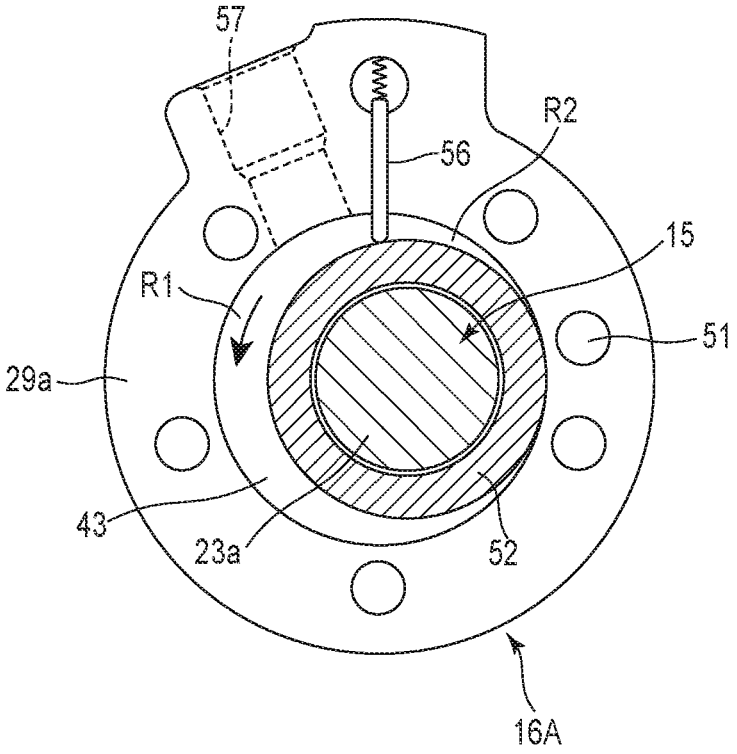
FIG. 4 is a cross-sectional view showing a positional relationship between a roller and a vane in a first cylinder chamber in the first embodiment.

As the first refrigerant compression unit 16A is shown as a representative in FIG. 4, a vane 56 is slidably provided on the first cylinder body 29*a*. The vane 56 can move in the direction of advancing to the first cylinder chamber 43 or retreating from the first cylinder chamber 43, and a distal end of the vane 56 is slidably pressed against the outer peripheral surface of the first roller 52.

The vane 56 cooperates with the first roller 52 to partition the first cylinder chamber 43 into a suction region R1 and a compression region R2. For this reason, when the first roller 52 rotates eccentrically in the first cylinder chamber 43, the volumes of the suction region R1 and the compression region R2 of the first cylinder chamber 43 change continuously. Although not shown, each of the second cylinder chamber 44 and the third cylinder chamber 45 is also divided into a suction region R1 and a compression region R2 by a similar vane.

As shown in FIG. 3, the first to third cylinder bodies 29*a*, 29*b*, and 29*c* have suction ports 57 that open to the suction regions R1 of the first to third cylinder chambers 43, 44, and 45. Furthermore, first to third connecting pipes 58*a*, 58*b*, and 58*c* are connected to the suction ports 57 of the first to third cylinder bodies 29*a*, 29*b*, and 29*c*. The first to third connecting pipes 58*a*, 58*b*, and 58*c* penetrate the peripheral wall 10*a* of the sealed container 10 and protrude to the outside of the sealed container 10.

As shown in FIG. 2, the accumulator 8 of the rotary compressor 2 is attached to the side of the sealed container 10 in a vertically standing posture. The accumulator 8 includes three branch pipes 59*a*, 59*b*, and 59*c* that distribute the vapor-phase refrigerant from which the liquid-phase refrigerant is separated to the compression mechanism unit 12. The branch pipes 59*a*, 59*b*, and 59*c* penetrate the bottom part of the accumulator 8 and are guided to the outside of the accumulator 8, and are airtightly connected to opening ends of the first to third connecting pipes 58*a*, 58*b*, and 58*c*.

As shown in FIG. 3, a recess portion 61 is formed on the upper surface of the end plate 37 of the first bearing 19. Similarly, a recess portion 62 is formed on the lower surface of the end plate 42 of the second bearing 20. First discharge ports 63*a* and 63*b* are formed at bottoms of the recess portions 61 and 62, respectively. The first discharge port 63*a* formed on the end plate 37 is opened into the first cylinder chamber 43 and the first muffler chamber 47. The first discharge port 63*b* formed on the end plate 42 is opened into the third cylinder chamber 45 and the second muffler chamber 49.

The first discharge ports 63*a* and 63*b* have, for example, a circular opening shape. A basic port diameter L1 of the first discharge ports 63*a* and 63*b* is, for example, 13 [mm]. A minimum cross-sectional area A1 of the first discharge ports 63*a* and 63*b* determined by the port diameter L1 is, for example, 132.7 [$mm^2$].

In the present embodiment, the minimum cross-sectional area A1 of the first discharge ports 63*a* and 63*b* is equal. However, the first discharge ports 63*a* and 63*b* may have minimum cross-sectional areas A1 different from each other.

A reed valve 64 for opening and closing the first discharge port 63*a* is incorporated in the recess portion 61 of the end plate 31. The reed valve 64 opens the first discharge port 63*a* when the pressure in the compression region R2 of the first cylinder chamber 43 reaches a predetermined value.

A reed valve 66 for opening and closing the first discharge port 63*b* is incorporated in the recess portion 62 of the end plate 42. The reed valve 66 opens the first discharge port 63*b* when the pressure in the compression region R2 of the third cylinder chamber 45 reaches a predetermined value.

As shown in FIG. 3, the plate element 31*a* of the first partition plate 11 and the plate element 32*a* of the second partition plate 18 cooperate with each other to sandwich the intermediate second cylinder body 29*b* located between the first cylinder body 29*a* and the third cylinder body 29*c*.

A recess portion 69 is formed on the upper surface of the plate element 31*a* of the first partition plate 17. Similarly, a recess portion 10 is formed on the lower surface of the plate element 32*a* of the second partition plate 18. Second discharge ports 71*a* and 71*b* are formed at bottoms of the recess portions 69 and 70, respectively. The second discharge port 71*a* formed in the plate element 31*a* is opened in the second cylinder chamber 44. The second discharge port 71*b* formed in the plate element 32*a* is also opened in the second cylinder chamber 44.

The second discharge ports 71*a* and 71*b* have, for example, a circular opening shape. A basic port diameter L2 of the second discharge port 11*a* is, for example, 6.5 [mm]. The minimum cross-sectional area A2 of the second discharge port 71*a* determined by the port diameter L2 is, for example, 33.2 [$mm^2$].

In contrast, the basic port diameter L2 of the other second discharge port 71*b* is, for example, 13 [mm]. A minimum cross-sectional area A2 of the other second discharge port 71*b* determined by the port diameter L2 is, for example, 132.7 [$mm^2$], in other words, the second discharge port 71*b* has a larger port diameter L2 and a larger minimum cross-sectional area A2 than the second discharge port 71*a*.

Therefore, in the second cylinder chamber 44, a pair of second discharge ports 71*a* and 71*b* having different sizes are provided on both sides along the thickness direction thereof.

A reed valve 72 that opens and closes the second discharge port 71*a* is incorporated in the recess portion 69 of the plate element 31*a* of the first partition plate 17. The reed valve 72 opens the second discharge port 71*a* when the pressure in the compression region R2 of the second cylinder chamber 44 reaches a predetermined value.

A reed valve 74 that opens and closes the second discharge port 71*b* is incorporated in the recess portion 70 of the plate element 32*a* of the second partition plate 13. The reed valve 74 opens the second discharge port 71*b* when the pressure in the compression region R2 of the second cylinder chamber 44 reaches a predetermined value.

Furthermore, a recess portion 77 is formed on the lower surface of the plate element 31*b* of the first partition plate 17. Similarly, a recess portion 78 is formed on the upper surface of the plate element 32*b* of the second partition plate 18. Third discharge ports 79*a* and 79*b* are formed at bottoms of the recesses 77 and 78, respectively. The third discharge port 79*a* formed in the plate element 31*b* is opened in the compression region R2 of the first cylinder chamber 43. The third discharge port 73*b* formed in the plate element 32*b* is opened in the compression region R2 of the third cylinder chamber 45.

The third discharge ports 79*a* and 79*b* have, for example, a circular opening shape. A basic port diameter L3 of the third discharge ports 73*a* and 79*b* is, for example, 6.5 [mm]. A minimum cross-sectional area A3 of the third discharge port 79*a* determined by the port diameter L3 is, for example, 33.2 [$mm^2$]. The minimum cross-sectional area A3 of the third discharge port 79*b* is smaller than the minimum cross-sectional area A1 of the first discharge ports 63*a* and 63*b*.

Therefore, in the first cylinder chamber 43, the first discharge port 63*a* and the third discharge port 79*a* having different sizes are provided on both sides along the thickness direction thereof. Similarly, in the third cylinder chamber 45, the first discharge port 63*b* and the third discharge port 79*b* having different sizes are provided on both sides along the thickness direction thereof.

Incidentally, in the present embodiment, the minimum cross-sectional area A3 of the third discharge ports 79*a* and 79*b* is equal. However, the third discharge ports 79*a* and 79*b* may have minimum cross-sectional areas A3 different from each other.

A reed valve 81 that opens and closes the third discharge port 79*a* is incorporated in the recess portion 77 of the plate element 31*b* of the first partition plate 17. The reed valve 81 opens the third discharge port 79*a* when the pressure in the compression region R2 of the first cylinder chamber 43 reaches a predetermined value.

Similarly, a reed valve 83 that opens and closes the third discharge port 73*b* is incorporated in the recess portion 73 of the plate element 32*b* of the second partition plate 18. The reed valve 33 opens the third discharge port 79*b* when the pressure in the compression region R2 of the third cylinder chamber 45 reaches a predetermined value.

As shown in FIG. 3, the recess portions 69 and 77 of the first partition plate 17 cooperate with each other to define a third muffler chamber 85 as an intermediate muffler chamber inside the first partition plate 17. The third muffler chamber 85 is made to communicate with the discharge passage 51 through a muffling inner passage 86 formed inside the first partition plate 17. The muffling passage 86 is located around the through hole 30 of the first partition plate 17.

According to the present embodiment, since the first partition plate 17 including the third muffler chamber 85 and the muffling passage 86 is located between the first cylinder body 29*a* and the second cylinder body 29*b*, the thickness is restricted. For this reason, the third muffler chamber 85 including the muffling passage 86 has a smaller capacity than the first muffler chamber 47 and the second muffler chamber 49.

The recess portions 70 and 78 of the second partition plate 18 cooperate with each other to define a fourth muffler chamber 87 as an intermediate muffler chamber inside the second partition plate 18. The fourth muffler chamber 87 is made to communicate with the discharge passage 51 through a muffling passage 38 formed inside the second partition plate 18. The muffling passage 38 is located around the bearing hole 33 of the second partition plate 16.

According to the present embodiment, the second partition plate 13 that rotatably supports the third journal portion 27 of the rotating shaft 15 is formed to be thicker than the first partition plate 17 having no bearing function. For this reason, the depth of the recess portion 70 can be sufficiently secured by making the plate element 32*a* having the bearing hole 33 thicker than the other plate elements 31*a*, 31*b*, and 32*b*.

Therefore, in the present embodiment, the capacity of the fourth muffler chamber 87 including the muffling passage 88 is smaller than the capacities of the first muffler chamber 47 and the second muffler chamber 49, but larger than the capacity of the third muffler chamber 85 including the third muffler chamber 86.

In such a three-cylinder rotary compressor 2, when the rotating shaft 15 is driven by the electric motor 11, the first to third rollers 52, 53, and 54 eccentrically rotate in the first to third cylinder chambers 43, 44, and 45. As a result, the volumes of the suction region R1 and the compression region R2 of the first to third cylinder chambers 43, 44, and 45 change, and the vapor-phase refrigerant in the accumulator 8 is sucked into the suction regions R1 of the first to third cylinder chambers 43, 44, and 45 through the three branch pipes 59*a*, 59*b*, and 59*c*.

The vapor-phase refrigerant sucked into the suction region R1 of the first cylinder chamber 43 is gradually compressed in the process in which the suction region R1 shifts to the compression region R2. When the pressure of the compressed vapor-phase refrigerant reaches a predetermined value, the reed valves 64 and 81 are opened and the first discharge port 63*a* and the third discharge port 79*a* are opened.

For this reason, the vapor-phase refrigerant compressed in the first cylinder chamber 43 is discharged from the first discharge port 63*a* to the first muffler chamber 47, and also discharged from the third discharge port 79*a* to the third muffler chamber 85. The vapor-phase refrigerant discharged to the third muffler chamber 85 is guided to the first muffler chamber 47 through the muffling passage 86 and the discharge passage 51 to merge with the vapor-phase refrigerant discharged from the first discharge port 63*a* in the first muffler chamber 47.

The vapor-phase refrigerant sucked into the suction region R1 of the second cylinder chamber 44 is gradually compressed in the process in which the suction region R1 shifts to the compression region R2. When the pressure of the compressed vapor-phase refrigerant reaches a predetermined value, the reed valves 72 and 74 are opened and the second discharge ports 71*a* and 71*b* are opened.

For this reason, the vapor-phase refrigerant compressed in the second cylinder chamber 44 is discharged to the third muffler chamber 35 through the second discharge port 71*a* and also discharged to the fourth muffler chamber 87 through the second discharge port 71*b*. The vapor-phase refrigerant discharged into the third muffler chamber 85 is guided to the first muffler chamber 47 through the muffling passage 86 and the discharge passage 51. The vapor-phase refrigerant discharged into the fourth muffler chamber 87 is guided to the first muffler chamber 47 through the muffling passage 88 and the discharge passage 51.

The vapor-phase refrigerant sucked into the suction region R1 of the third cylinder chamber 45 is gradually compressed in the process in which the suction region R1 shifts to the compression region R2. When the pressure of the compressed vapor-phase refrigerant reaches a predetermined value, the reed valves 66 and 83 are opened and the first discharge port 63*b* and the third discharge port 79*b* are opened. For this reason, the vapor-phase refrigerant compressed in the third cylinder chamber 45 is discharged from the first discharge port 63*b* to the second muffler chamber 49 and also discharged from the third discharge port 79*b* to the fourth muffler chamber 87. The vapor-phase refrigerant discharged into the second muffler chamber 49 is guided to the first muffler chamber 47 through the discharge passage 51. The vapor-phase refrigerant discharged into the fourth muffler chamber 37 is guided to the first muffler chamber 47 through the muffling passage 83 and the discharge passage 51.

According to the present embodiment, a part of the vapor-phase refrigerant compressed in the first cylinder chamber 43 and a part of the vapor-phase refrigerant compressed in the second cylinder chamber 44 are discharged from the third discharge port 79*a* and the second discharge port 71*a* to the common third muffler chamber 85.

Similarly, a part of the vapor-phase refrigerant compressed in the third cylinder chamber 45 and the rest of the vapor-phase refrigerant compressed in the second cylinder chamber 44 are discharged from the third discharge port 79*b* and the second discharge port 71*b* to the common fourth muffler chamber 87.

In other words, the vapor-phase refrigerant compressed in the first to third cylinder chambers 43, 44, and 45 is discharged from both sides along the thickness direction, of the first to third cylinder chambers 43, 44, and 45, respectively.

At this time, since the eccentric directions of the first to third crank portions 23*a*, 23*b*, and 23*c* of the rotating shaft 15 are deviated by 120° in the circumferential direction of the rotating shaft 15, an equivalent phase difference is made at the timing at which the vapor-phase refrigerant compressed in the first to third cylinder chambers 43, 44, and 45 is discharged.

For this reason, the vapor-phase refrigerant discharged from the first cylinder chamber 43 to the third muffler chamber 85 and the vapor-phase refrigerant discharged from the second cylinder chamber 44 to the third muffler chamber 65 do not interfere with each other in the third muffler chamber 85. Similarly, the vapor-phase refrigerant discharged from the third cylinder chamber 45 to the fourth muffler chamber 67 and the vapor-phase refrigerant discharged from the second cylinder chamber 44 to the fourth muffler chamber 87 are the fourth. They do not interfere with each other in the muffler chamber 87.

Therefore, the vapor-phase refrigerant discharged into the third, muffler chamber 65 and the fourth muffler chamber 37 is guided to the first muffler chamber 47 through the discharge passage 51 without causing a large loss.

The vapor-phase refrigerant discharged to the second to fourth muffler chambers 49, 85, and 87 merges with the vapor-phase refrigerant discharged from the first discharge port 63*a* in the first muffler chamber 47, and then continuously discharged from an exhaust hole of the first muffler cover 46 into the sealed container 10. The vapor-phase refrigerant discharged into the sealed container 10 passes through the electric motor 11 and is guided from the discharge pipe 10*b* to the four-way valve 3.

According to the first embodiment, the first partition plate 17 and the second partition plate 13 sandwiching the intermediate second cylinder chamber 44 located between the first cylinder chamber 43 and the third cylinder chamber 45 comprise the second discharge ports 71*a* and 71*b* that open into the second cylinder chamber 44, and the third muffler chamber 85 and the fourth muffler chamber 87 that are connected to the second discharge ports 71*a* and 71*b*, respectively.

For this reason, the vapor-phase refrigerant compressed in the second cylinder chamber 44 is discharged from both sides along the thickness direction of the second cylinder chamber 44 to the third, muffler chamber 85 and the fourth muffler chamber 87 through the pair of discharge ports 71*a* and 71*b*. Therefore, although the thicknesses of the first partition plate 17 and the second partition plate 13 that sandwich the second cylinder chamber 44 are limited, the flow rate of the vapor-phase refrigerant discharged from the second cylinder chamber 44 can be increased and the discharge loss and discharge pressure pulsation of the vapor-phase refrigerant can be reduced.

Moreover, in the first embodiment, the first discharge port 63*a* formed on the first bearing 19 and the third discharge port 79*a* formed on the first chamber 43. For this reason, the vapor-phase refrigerant compressed in the first cylinder chamber 43 is discharged from the first discharge port 63*a* and the third discharge port 79*a* to both the first muffler chamber 47 and the third muffler chamber 85.

In addition, since the first discharge port 63*b* formed on the second bearing 20 and the third discharge port 79*b* formed on the second partition plate 18 are opened in the third cylinder chamber 45, the vapor-phase refrigerant compressed in the cylinder chamber 45 is discharged from the first discharge port 63*b* and the third discharge port 79*b* to both the second muffler chamber 49 and the fourth muffler chamber 37.

As a result, ail the vapor-phase refrigerant compressed in the first to third cylinder chambers 43, 44, and 45 is discharged from the two discharge ports, and the passage resistance and the discharge pressure pulsation are suppressed to a low level when the vapor-phase refrigerant passes through each of the discharge ports. Therefore, the vapor-phase refrigerant compressed in the first to third cylinder chambers 43, 44, and 45 can be discharged more efficiently, and a high-performance rotary compressor 2 can be obtained.

At the same time, each of the region from the third muffler chamber 85 to the muffling passage 66 of fourth muffler chamber 67 to the muffling passage 88 of the second partition plate 18 can be used as space for muffling. For this reason, the noise generated when the compressed, vapor-phase refrigerant flows can be reduced, and quiet operation can be performed.

As shown in FIG. 3, the first discharge port 63*a* and the third discharge port 79*a* that open into the first cylinder chamber 43 have different sizes. Similarly, the second discharge ports 71*a* and 71*b* that open into the second cylinder chamber 44 have different sizes, and the first discharge port 63*b* and the third discharge port 79*b* that open into the third cylinder chamber 45 are also different in size from each other.

Therefore, the discharge flow rate of the vapor-phase refrigerant discharged on both sides along the thickness direction of the first to third cylinder chambers 43, 44, and 45 can be made different from each other, in each of the first to third cylinder chambers 43, 44, and 45.

More specifically, in the first embodiment, the first muffler chamber 47 attached to the first bearing 19 and the second muffler chamber 49 attached to the second bearing 20 have a larger capacity than that of the third muffler chamber 85 inside the first partition plate 17 and the fourth muffler chamber 87 inside the second partition plate 18.

Therefore, by designing the first discharge ports 63*a* and 63*b* that open to the first muffler chamber 47 and the second muffler chamber 49 to be larger than the third discharge ports 79*a* and 79 that open to the third muffler chamber 85 and the fourth muffler chamber 37, the flow rate of the vapor-phase refrigerant discharged from the first discharge ports 63*a* and 63*b* and the third discharge ports 79*a* and 79*b* can be optimized so as to correspond to the capacities of the first to fourth muffler chambers 47, 49, 85, and 37.

Furthermore, when the first discharge ports 63*a* and 63*b* nave a size corresponding to the capacities of the first muffler chamber 47 and the second muffler chamber 49, the flow rate of the vapor-phase refrigerant discharged from the first cylinder chamber 43 and the third cylinder chamber 45 can be secured even if the third discharge ports 79*a* and 79*b* that open in the third muffler chamber 85 and the fourth muffler chamber 87 having a small capacity than the first muffler chamber 47 and the second muffler chamber 49 are downsized.

Therefore, the vapor-phase refrigerant compressed in the first and third cylinder chambers 43 and 45 can be discharged efficiently, which is more convenient for improving the performance of the rotary compressor 2.

In addition, since the second partition plate 13 having a bearing function is formed to be thicker than the first partition plate 17 through which the rotating shaft 15 only penetrates, the capacity of the fourth muffler chamber 87 can be increased as compared with the capacity of the third muffler chamber 85.

In particular, in the present embodiment, the total value of the minimum cross-sectional area A2 of the second discharge port 71*a* and the minimum cross-sectional area A3 of the third discharge port 79*a*, which are formed on the first partition plate 17, is 66.4 [$mm^2$]. In contrast, the total value of the minimum cross-sectional area A2 of the second discharge port 71*b* and the minimum cross-sectional area A3 of the third discharge pert 79*b*, which are formed on the second partition plate 18, is 165.9 [$mm^2$], As a result, the flow rate of the vapor-phase refrigerant discharged to the fourth muffler chamber 87 having a large capacity can be increased, and the inside of the second partition plate 18 can be effectively utilized as a flow path for the vapor-phase refrigerant.

As shown in FIG. 3, the second partition plate 18 is located on a side closer to the second muffler chamber 49 than the first partition plate 17, and the first partition plate 17 is located on a side closer to the first muffler chamber 47 than the second partition plate 18. In other words, the fourth muffler chamber 87 inside the second partition plate 18 is located on a side farther from the first muffler chamber 47 than the third muffler chamber 85 inside the first partition plate 17.

As a result, the flow path of the refrigerant from the fourth muffler chamber 87 to the first muffler chamber 47 becomes much longer than the flow path of the refrigerant from the third muffler chamber 85 to the first muffler chamber 47. In other words, the capacity of the flow path of the refrigerant increases, but the flow path resistance applied to the vapor-phase refrigerant increases as the flow path becomes longer. As a result, the discharge pressure pulsation of the vapor-phase refrigerant flowing from the fourth muffler chamber 81 to the first muffler chamber 47 is suppressed and the muffling effect can be enhanced.

Furthermore, in the first embodiment, as described above, the total value of the minimum cross-sectional area A2 of the second discharge port 71*b* and the minimum cross-sectional area A3 of the third discharge port 79*b*, which are formed on the second partition plate 18, is larger than the total value of the minimum cross-sectional area A2 of the second discharge port 71*a* and the minimum cross-sectional area A3 of the third discharge port 79*a*, which are formed on the first partition plate 17.

Thus, the flow rate of the vapor-phase refrigerant discharged to the fourth muffler chamber 87 located on the side far from the first muffler chamber 47 can be increased, and a high-performance rotary compressor 2 can be obtained while increasing the capacity of the flow path and suppressing the noise during the operation.

Second Embodiment

Figure 5:
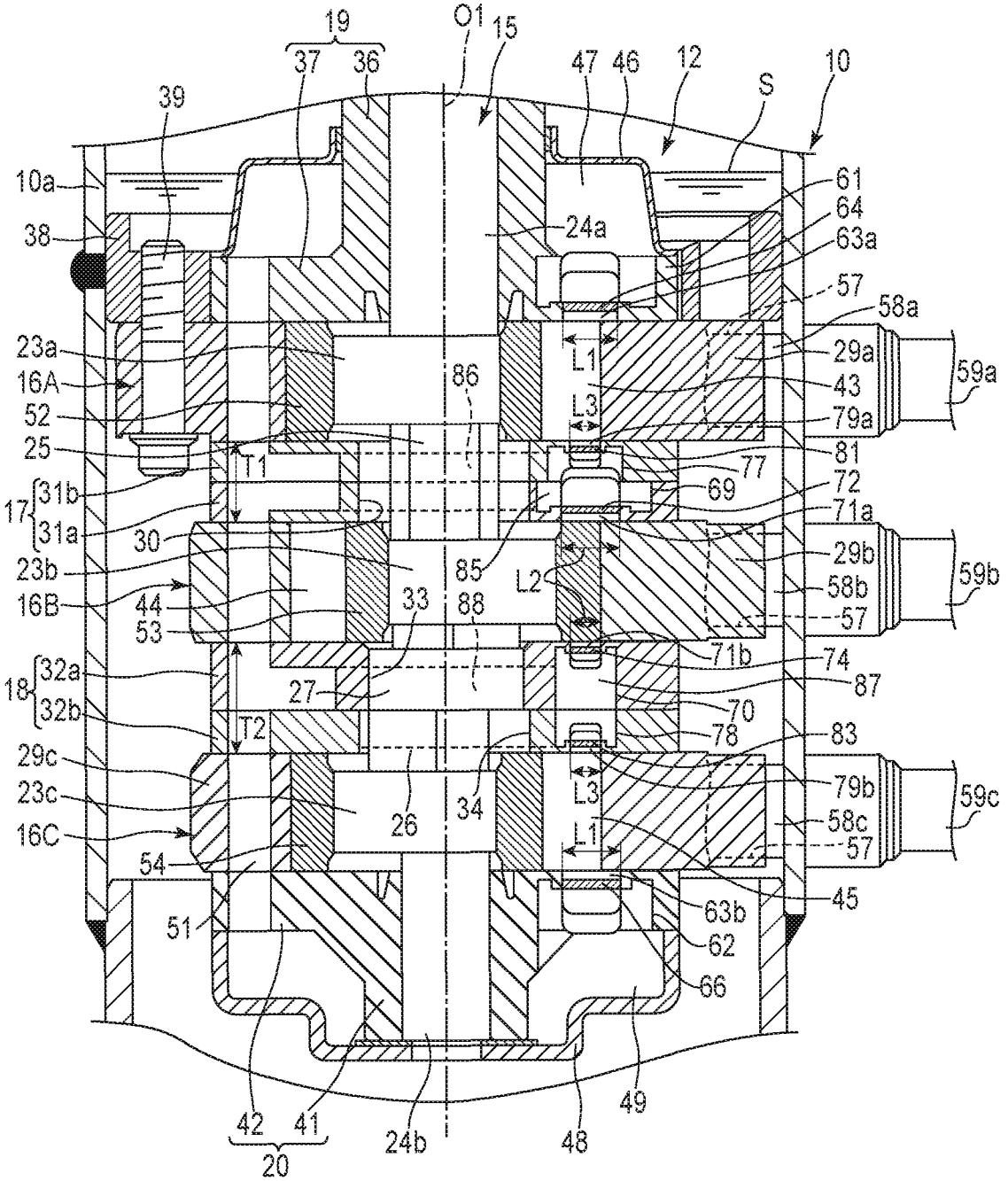
FIG. 5 is an enlarged cross-sectional view showing a three-cylinder rotary compressor according to a second embodiment.

FIG. 5 discloses a second embodiment. The second embodiment is different from the first embodiment with respect to elements related to the size of the first to third discharge ports 63*a*, 63*b*, 71*a*, 71*b*, 79*a*, and 79*b* opened in the first to third cylinder chambers 43, 44, and 45, and is the same as the first embodiment with respect to the configuration of the rotary compressor 2 other than the above. For this reason, in the second embodiment, the same reference numerals are denoted to the same constituent portions as those in the first embodiment, and their descriptions will be omitted.

In the second embodiment, as shown in FIG. 5, the basic port diameter L2 and the minimum cross-sectional area A2 of the second discharge port 71*a* formed on the first partition plate 17 are set to be equivalent to, for example, the basic port diameter L1 and the minimum cross-sectional area A1 of the first discharge ports 63*a* and 63*b*.

Furthermore, the basic port diameter L2 and the minimum cross-sectional area A2 of the second discharge port 71*b* formed on the second partition plate 18 are set to be equivalent to, for example, the basic port diameter L3 and the minimum cross-sectional area A3 of the third discharge ports 79*a* and 79*b*.

For this reason, the total value of the minimum cross-sectional region A2 of the second discharge port 71*a* and the minimum cross-sectional region A3 of the third discharge port 79*a*, which are formed on the first partition plate 17, is 66.4 [$mm^2$]. In contrast, the total value of the minimum cross-sectional region A2 of the second discharge port 71*b* and the minimum cross-sectional region A3 of the third discharge port 79*b*, which are formed on the second partition plate 18, is 165.9 [$mm^2$].

As a result, the flow rate of the vapor-phase refrigerant discharged to the third muffler chamber 85 located on the side near the first muffler chamber 47 where the vapor-phase refrigerant discharged from the first to third cylinder chambers 43, 44, and 45 merges can be increased.

Furthermore, since the third muffler chamber 85 is adjacent to the first muffler chamber 47 with the first cylinder body 29*a* provided therebetween, the flow path of the refrigerant from the third muffler chamber 85 to the first muffler chamber 47 is significantly shorter than the flow path of the refrigerant from the fourth muffler chamber 87 to the first muffler chamber 47.

As a result, the high-performance rotary compressor 2 capable of suppressing the flow path loss of the vapor-phase refrigerant from the third muffler chamber 85 to the first muffler chamber 47 and increasing the flow rate of the vapor phase refrigerant can be obtained.

Third Embodiment

Figure 6:
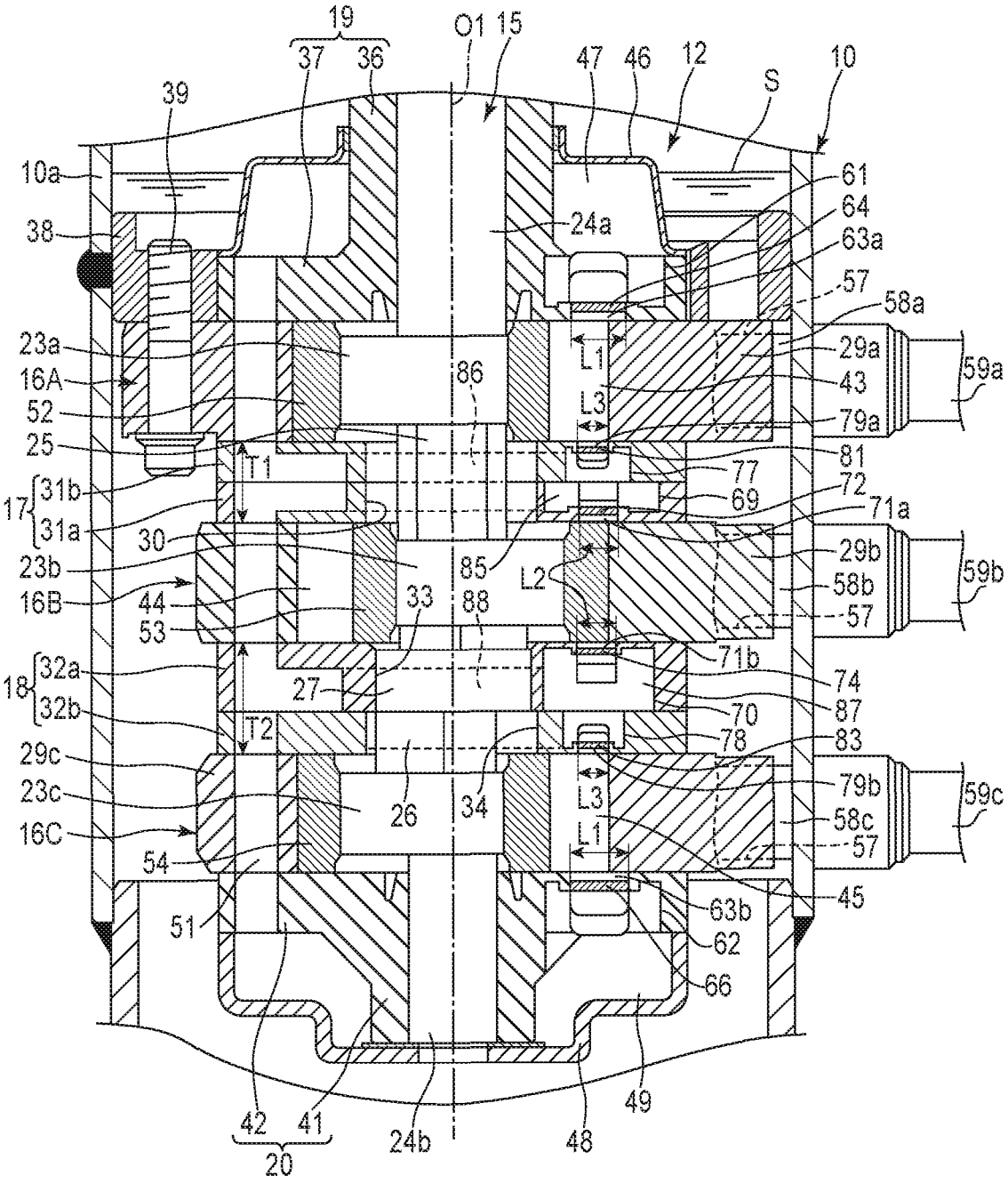
FIG. 6 is an enlarged cross-sectional view showing a three-cylinder rotary compressor according to a three embodiment.

FIG. 6 discloses a third embodiment. The third embodiment is different from the first embodiment with respect to elements related to the size of the first to third discharge ports 63*a*, 63*b*, 71*a*, 71*b*, 79*a*, and 79*b* opened in the first to third cylinder chambers 43, 44, and 45, and is the same as the first embodiment with respect to the configuration of the rotary compressor 2 other than the above. For this reason, in the third embodiment, the same reference numerals are denoted to the same constituent portions as those in the first embodiment, and their descriptions will be omitted.

In the third embodiment, as shown in FIG. 6, the basic port diameter L2 and the minimum cross-sectional area A2 of the second discharge port 71*a* formed on the first partition plate 17 are set to be intermediate values between the basic port diameter L1 and the minimum cross-sectional area A1 of the first discharge ports 63*a* and 63*b*, and the port diameter L3 and the minimum cross-sectional area A3 of the third discharge ports 79*a* and 79*b*, respectively.

Similarly, the basic port diameter L2 and the minimum cross-sectional area A2 of the second discharge port lib formed on the second partition plate 18 are set to be intermediate values between the basic port diameter L1 and the minimum cross-sectional area A1 of the first discharge ports 63*a* and 63*b*, and the basic port diameter L3 and the minimum cross-sectional area A3 of the third discharge ports 79*a* and 79*b*, respectively.

More specifically, the minimum cross-sectional area A2 of the second discharge ports 71*a* and 71*b* is, for example, 60.3 [mud]. Therefore, the minimum cross-sectional area A1 of the first discharge ports 63*a* and 63*b*, the minimum cross-sectional area A2 of the second discharge ports 71*a* and 71*b*, and the minimum cross-sectional area A3 of the third discharge ports 79*a* and 79*b* meet a relationship A1>A2>A3.

As a result, the second discharge ports 71*a* and 71*b* that open in the second cylinder chamber 44 between the first cylinder chamber 43 and the third cylinder chamber 45 have an opening shape smaller than the first discharge ports 63*a* and 63*b* and larger than the third discharge ports 79*a* and 79*b*.

According to the third embodiment, the first partition plate 17 and the second partition plate 18 sandwiching the second cylinder chamber 44 include the smallest third discharge ports 79*a* and 79*b* and the second discharge ports 71*a* and 71*b* having an intermediate size. The second discharge ports 71*a* and 71*b* having an intermediate size are opened in the second cylinder chamber 44, and the smallest third discharge ports 79*a* and 79*b* are opened to both the first cylinder chamber 43 and the third cylinder chamber 45.

According to this configuration, the largest first discharge ports 63*a* and 63*b* and the smallest third discharge ports 79*a* and 79*b* open in the first cylinder chamber 43 and the third cylinder chamber 45, respectively, and the second discharge ports 71*a* and 71*b* having an intermediate size open in the second cylinder chamber 44.

Therefore, the flow rate of the vapor-phase refrigerant discharged from the first discharge ports 63*a* and 63*b*, the second discharge ports 71*a* and 71*b*, and the third discharge ports 79*a* and 79*b* can be optimized to correspond to the capacities of the first to fourth muffler chambers 47, 49, 85, and 87. Therefore, the vapor-phase refrigerant compressed in the first to third cylinder chambers 43, 44, and 45 can be discharged more efficiently, and the performance of the rotary compressor 2 can be enhanced.

In addition, since the second partition plate 18 having a bearing function is formed to be thicker than the first first partition plate 17 through which the rotating shaft 15 only penetrates, the capacity of the fourth muffler chamber 87 can be made larger than the capacity of the third muffler chamber 85. For this reason, there is an advantage that the flow rate of the vapor-phase refrigerant discharged to the fourth muffler chamber 87 having a large capacity can be increased by making the second discharge port 71*b* opened in the fourth muffler chamber 87 larger than the third discharge port 79*b*, which effectively contributes to improvement of the performance of the rotary compressor 2.

In the above embodiments, the opening shape of the discharge port is a circular shape. However, the opening shape of the discharge port is not particularly limited, but may be, for example, a polygonal shape or a D shape in which an are and a straight line are combined.

In the above embodiments, the three-cylinder rotary compressor including three cylinder chambers has been described. However, the embodiments can also be applied to, for example, a rotary compressor having four or more cylinder chambers, similarly.

Furthermore, in the above embodiments, an example of a general rotary compressor in which the vane advances in the cylinder chamber following the eccentric rotation of the roller or moves in the direction of retreating from the cylinder chamber has been described. However, the embodiments can also be applied to, for example, a so-called swing-type rotary compressor in which vanes are made to integrally project from the outer peripheral surface of the roller toward the radial outer side of the roller.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions,

What is claimed is:

1. A rotary compressor comprising:

a sealed container;

a compression mechanism unit compressing a working fluid inside the sealed container; and a drive source accommodated in the sealed container to drive the compression mechanism unit, the compression mechanism unit including:

a rotating shaft connected to the drive source inside the sealed container;

a first bearing and a second bearing rotatably supporting the rotating shaft and including end plates extending in a radial direction of the rotating shaft;

a first muffler chamber attached to the first bearing;

a second muffler chamber attached to the second bearing;

at least three cylinder bodies interposed between the first bearing and the second bearing, and spaced apart and arranged in an axial direction of the rotating shaft, each defining a cylinder chamber;

a plurality of partition plates provided between the adjacent cylinder bodies; and a plurality of rollers fitted in the rotating shaft to compress the working fluid in the cylinder chambers, the cylinder chambers of the at least three cylinder bodies being partitioned in an axial direction of the rotating shaft by the end plate of the first bearing, the end plate of the second bearing, and the partition plates, each of the end plate of the first bearing and the end plate of the second bearing including a first discharge port discharging the working fluid compressed in the cylinder chamber of a cylinder body adjacent to the end plate to the first muffler chamber and the second muffler chamber, the plurality of partition plates that sandwich an intermediate cylinder body located between the two cylinder bodies adjacent to the end plates, each including an intermediate muffler chamber in which the working fluid flows, and a second discharge port discharging the working fluid compressed in the cylinder chamber of the intermediate cylinder body to the intermediate muffler chamber, wherein one or more of the partition plates is composed of a pair of plate elements overlaid in an axial direction of the rotating shaft, one of the plate elements abuts on the intermediate cylinder body and includes the second discharge port, the other plate element abuts on the cylinder body adjacent to the end plate and includes a third discharge port discharging the working fluid compressed in the cylinder chamber of the cylinder body adjacent to the end plate to the intermediate muffler chamber, minimum cross-sectional areas of the first discharge port and the third discharge port communicating with the cylinder chambers of the cylinder bodies adjacent to the end plates of the first and second bearings are different from each other, and minimum cross-sectional areas of the plurality of second discharge ports communicating with the cylinder chamber of the intermediate cylinder body are different from each other.

2. The rotary compressor of claim 1, wherein capacities of the first muffler chamber and the second muffler chamber are larger than a capacity of the intermediate muffler chamber.

3. The rotary compressor of claim 1, wherein the minimum cross-sectional area of the first discharge port is larger than the minimum cross-sectional areas of the second discharge port and the third discharge port.

4. The rotary compressor of claim 3, wherein the compression mechanism unit includes a discharge passage connecting the first muffler chamber and the second muffler chamber, and the working fluid discharged to the second muffler chamber is guided to the first muffler chamber via the discharge passage and merges with the working fluid discharged to the first muffler chamber, in the first muffler chamber, and a total value of the minimum cross-sectional areas of the second discharge port and the third discharge port, which are provided on the partition plate located on a side closer to the second muffler chamber than the first muffler chamber, is larger than a total value of the minimum cross-sectional areas of the second discharge port and the third discharge port, which are provided on the partition plate located on a side closer to the first muffler chamber than the second muffler chamber.

5. The rotary compressor of claim 3, wherein the compression mechanism unit includes a discharge passage connecting the first muffler chamber and the second muffler chamber, and the working fluid discharged to the second muffler chamber is guided to the first muffler chamber via the discharge passage and merges with the working fluid discharged to the first muffler chamber, in the first muffler chamber, and a total value of the minimum cross-sectional areas of the second discharge port and the third discharge port, which are provided on the partition plate located on a side closer to the first muffler chamber than the second muffler chamber, is larger than a total value of the minimum cross-sectional areas of the second discharge port and the third discharge port, which are provided on the partition plate located on a side closer to the second muffler chamber than the first muffler chamber.

6. The rotary compressor of claim 3, wherein the rotating shaft includes an intermediate shaft portion located between the adjacent cylinder body, any one of the partition plates includes a bearing hole slidably supporting the intermediate shaft portion of the rotating shaft, and a thickness of the partition plate including the bearing hole is larger than a thickness of the other partition plates which the rotating shaft penetrates, and a total value of the minimum cross-sectional areas of the second discharge port and the third discharge port, which are provided on the partition plate including the bearing hole, is larger than a total value of the minimum cross-sectional areas of the second discharge port and the third discharge port, which are provided on the other partition plate.

7. A refrigeration cycle apparatus comprising:

a circulation circuit in which a refrigerant serving as a working fluid circulates and to which a radiator, an expansion device, and a heat absorber are connected; and the rotary compressor of claim 1 connected to the circulation circuit at a position between the radiator and the neat absorber.

8. A rotary compressor comprising:

a sealed container;

a compression mechanism unit compressing a working fluid inside the sealed container; and a drive source accommodated in the sealed container to drive the compression mechanism unit, the compression mechanism unit including:

a rotating shaft connected to the drive source inside the sealed container;

a first bearing and a second bearing rotatably supporting the rotating shaft and including end plates extending in a radial direction of the rotating shaft;

a first muffler chamber attached to the first bearing;

a second muffler chamber attached to the second bearing;

at least three cylinder bodies interposed between the first bearing and the second bearing, and spaced apart and arranged in an axial direction of the rotating shaft, each defining a cylinder chamber;

a plurality of partition plates provided between the adjacent cylinder bodies; and a plurality of rollers fitted in the rotating shaft to compress the working fluid in the cylinder chambers, the cylinder chambers of the at least three cylinder bodies being partitioned in an axial direction of the rotating shaft by the end plate of the first bearing, the end plate of the second bearing, and the partition plates, each of the end plate of the first bearing and the end plate of the second bearing including a first discharge port discharging the working fluid compressed in the cylinder chamber of a cylinder body adjacent to the end plate to the first muffler chamber and the second muffler chamber, the plurality of partition plates that sandwich an intermediate cylinder body located between the two cylinder bodies adjacent to the end plates, each including an intermediate muffler chamber in which the working fluid flows, and a second discharge port discharging the working fluid compressed in the cylinder chamber of the intermediate cylinder body to the intermediate muffler chamber, wherein one or more of the partition plates is composed of a pair of plate elements overlaid in an axial direction of the rotating shaft, one of the plate elements abuts on the intermediate cylinder body and includes the second discharge port, the other plate element abuts on the cylinder body adjacent to the end plate and includes a third discharge port discharging the working fluid compressed in the cylinder chamber of the cylinder body adjacent to the end plate to the intermediate muffler chamber, and when the minimum cross-sectional area of the first discharge port is referred to as A1, the minimum cross-sectional area of the second discharge port is referred to as A2, and the minimum cross-sectional area of the third discharge port is referred to as A3, a relationship A1>A2>A3 is met.

9. The rotary compressor of claim 8, wherein capacities of the first muffler chamber and the second muffler chamber are larger than a capacity of the intermediate muffler chamber.

10. A refrigeration cycle apparatus comprising:

a circulation circuit in which a refrigerant serving as a working fluid circulates and to which a radiator, an expansion device, and a heat absorber are connected; and the rotary compressor of claim 8 connected to the circulation circuit at a position between the radiator and the heat absorber.

11. A rotary compressor comprising:

a sealed container;

a compression mechanism unit compressing a working fluid inside the sealed container; and a drive source accommodated in the sealed container to drive the compression mechanism unit, the compression mechanism unit including:

a rotating shaft connected to the drive source inside the sealed container;

a first bearing and a second bearing rotatably supporting the rotating shaft and including end plates extending in a radial direction of the rotating shaft;

a first muffler chamber attached to the first bearing;

a second muffler chamber attached to the second bearing;

at least three cylinder bodies interposed between the first bearing and the second bearing, and spaced apart and arranged in an axial direction of the rotating shaft, each defining a cylinder chamber;

a plurality of partition plates provided between the adjacent cylinder bodies; and a plurality of rollers fitted in the rotating shaft to compress the working fluid in the cylinder chambers, the cylinder chambers of the at least three cylinder bodies being partitioned in an axial direction of the rotating shaft by the end plate of the first bearing, the end plate of the second bearing, and the partition plates, each of the end plate of the first bearing and the end plate of the second bearing including a first discharge port discharging the working fluid compressed in the cylinder chamber of a cylinder body adjacent to the end plate to the first muffler chamber and the second muffler chamber, the plurality of partition plates that sandwich an intermediate cylinder body located between the two cylinder bodies adjacent to the end plates, each including an intermediate muffler chamber in which the working fluid flows, and a second discharge port discharging the working fluid compressed in the cylinder chamber of the intermediate cylinder body to the intermediate muffler chamber, wherein one or more of the partition plates is composed of a pair of plate elements overlaid in an axial direction of the rotating shaft, one of the plate elements abuts on the intermediate cylinder body and includes the second discharge port, the other plate element abuts on the cylinder body adjacent to the end plate and includes a third discharge port discharging the working fluid compressed in the cylinder chamber of the cylinder body adjacent to the end plate to the intermediate muffler chamber, and the rotating shaft includes an intermediate shaft portion located between the adjacent cylinder bodies, any one of the partition plates includes a bearing hole slidably supporting the intermediate shaft portion of the rotating shaft, and a minimum cross-sectional area of the second discharge port provided on the plate element constituting the partition plate is smaller than a minimum cross-sectional area of the first discharge port and larger than a minimum cross-sectional area of the third discharge port.

12. The rotary compressor of claim 11, wherein capacities of the first muffler chamber and the second muffler chamber are larger than a capacity of the intermediate muffler chamber.

13. A refrigeration cycle apparatus comprising:

a circulation circuit in which a refrigerant serving as a working fluid circulates and to which a radiator, an expansion device, and a heat absorber are connected; and the rotary compressor of claim 11 connected to the circulation circuit at a position between the radiator and the heat absorber.

* * * * *